US006737977B2

(12) United States Patent
Nishikawa et al.

(10) Patent No.: US 6,737,977 B2
(45) Date of Patent: May 18, 2004

(54) FIRE DETECTOR UNIT

(75) Inventors: Takayuki Nishikawa, Osaka (JP); Shoichi Oka, Matsuzaka (JP); Koji Sakamoto, Takarazuka (JP); Takeshi Wada, Tsu (JP); Yasuyuki Kawano, Hirakata (JP); Kenji Toyoda, Hirakata (JP); Naoya Nagasawa, Ise (JP); Shinji Kirihata, Kyoto (JP)

(73) Assignee: Matsushita Electric Works, Ltd., Kadoma (JP)

( * ) Notice: Subject to any disclaimer, the term of this patent is extended or adjusted under 35 U.S.C. 154(b) by 17 days.

(21) Appl. No.: 10/040,629

(22) Filed: Jan. 9, 2002

(65) Prior Publication Data

US 2002/0154018 A1 Oct. 24, 2002

(30) Foreign Application Priority Data

Apr. 24, 2001 (JP) ..... 2001-126771
May 28, 2001 (JP) ..... 2001-158303
May 28, 2001 (JP) ..... 2001-158343

(51) Int. Cl.[7] ..... G08B 17/10

(52) U.S. Cl. ..... 340/628; 340/629; 340/630; 340/578; 340/583; 250/506.1; 250/515.1; 250/574

(58) Field of Search ..... 340/628, 629, 340/630, 632, 577, 578, 579, 581, 583; 250/574, 515.1, 506.1

(56) References Cited

U.S. PATENT DOCUMENTS 4,099,178 A * 7/1978 Ranney et al. ..... 340/515
4,168,438 A * 9/1979 Morisue ..... 250/574
4,672,217 A 6/1987 Dobrzanski ..... 250/574
4,758,733 A * 7/1988 Mochizuki ..... 250/574
4,829,283 A * 5/1989 Spang et al. ..... 340/506
5,138,302 A * 8/1992 Nagaoka et al. ..... 340/630
5,486,816 A * 1/1996 Ariga et al. ..... 340/630
5,546,074 A 8/1996 Bernal et al. ..... 340/628
5,699,043 A * 12/1997 Vane et al. ..... 340/514
5,764,142 A * 6/1998 Anderson et al. ..... 340/511
5,821,866 A * 10/1998 Bernal et al. ..... 340/630
5,939,994 A * 8/1999 Meier et al. ..... 340/693.9
6,057,774 A 5/2000 Venzant ..... 340/628
6,195,014 B1 * 2/2001 Sakurai et al. ..... 340/630
2002/0089426 A1 * 7/2002 Qualey et al. ..... 340/628

FOREIGN PATENT DOCUMENTS

JP 4-108293 * 9/1992
JP 40-7103892 * 5/1993

* cited by examiner

*Primary Examiner*—Daniel J. Wu
*Assistant Examiner*—Son Tang
(74) *Attorney, Agent, or Firm*—Oblon, Spivak, McClelland, Maier & Neustadt, P.C.

(57) ABSTRACT

An improved fire detector unit has a plastic base defining a smoke chamber for detection of a smoke density in terms of light scattering due to the smoke particles in the smoke chamber. The base carries a circuit board mounting a light emitting element, a light receiving element, and other components forming a fire detecting circuit responsible for generating a fire warning signal based upon the detected smoke density. A metal-made electromagnetic shield is molded into the base to protect the light receiving element from electromagnetic radiation noises. The electromagnetic shield includes a ground terminal for connection with a ground line of the circuit board. In addition, terminal pins are molded into the base for electrical and physical connection of the circuit board to the base.

6 Claims, 15 Drawing Sheets

FIRE DETECTOR UNIT

BACKGROUND OF THE INVENTION

1. Field of the Invention

The present invention is directed to a fire detector unit, and more particularly to a fire detector unit of a scattering light detection type.

2. Description of the Prior Art

Fire detector units of a scattering light detection type have been widely utilized to monitor a smoke density which is proportional to an amount of light scattering due to the presence of smoke particles, and to determine the fire presence by comparing the smoke density with a predetermined threshold. Japanese Utility Model Publication No. 4-108293 discloses one typical fire detector unit which includes a base with a smoke chamber, a light emitting diode directing an incident light into the smoke chamber, and a photo diode collecting a light scattering due to the smoke particles in the smoke chamber to generate an electric signal indicative of the amount of the light received. The electric signal is processed at a fire detecting circuit which provides a fire warning signal when the detected smoke density becomes critical. Included in the detector unit is a circuit board which is secured to the base and mounts the light emitting diode, the photo diode, and electronic components forming the fire detecting circuit. In order to make an electromagnetic shield over a particular portion of the electric circuitry for protection against a possible radiation noise, the detector unit is provided with a metal-made shield which is formed separately from the base and is assembled together with the circuit board on the base. Since the shield is formed separately from the base, an extra work is required to apply the shield to the circuit board and fix the shield to the base, in addition to mounting the circuit board to the base, when assembling the detector unit, thereby lowering manufacturing efficiency. Therefore, it is not easy to assemble the detector unit at a low manufacturing cost with the use of an automatic fabrication technique.

SUMMARY OF THE INVENTION

In view of the above insufficiency, the present invention has been achieved to provide an improved fire detector unit which is capable of being fabricated efficiently at a low cost, yet assuring a desired electromagnetic shield over a portion of an electric circuitry inherent to the detector unit. The fire detector unit in accordance with the present invention includes a base made of a molded plastic to have a labyrinth wall which projects on the circumference of the base to define therein a smoke chamber. The labyrinth wall permits an entry of smoke particles but prohibits the entry of an ambient light into the smoke chamber. The base carries a light projector which directs an incident light from a light emitting element into the smoke chamber. The base also carries a light collector which collects a light scattered by the smoke particles in the smoke chamber to a light receiving element. The light receiving element generates an electric signal indicative of the amount of the light received. A fire detecting circuit is connected to receive the electric signal so as to provide a fire warning signal based upon the electric signal. The light emitting element, the light receiving element, and the electronic components forming the fire detecting circuit are mounted on a circuit board which is assembled on the base. Included in the detector unit is a metal-made electromagnetic shield which protects the light receiving element from electromagnetic radiation noises.

The characterizing feature of the present invention resides in that the electromagnetic shield is integrally molded into the base and has a ground terminal for connection with a ground line of the circuit board, and that the circuit board is fixed to the base by means of metal-made terminal pins which are also integrally molded in the base for electrical connection with the fire detecting circuit and which project through the circuit board for connection with an external line. With the provision of the molded-in electromagnetic shield and the molded-in terminal pins, the electrical connection of the shield to the electric circuitry as well as the connection of the circuit board to the base can be made simultaneously simply by mounting the circuit board to the base, thereby facilitating the assembly of the detector unit.

In a preferred embodiment, the labyrinth wall is molded together with the base to form a unitary structure in which the electromagnetic shield is embedded, thereby reducing the number of the parts for easy assembly of the detector unit.

Preferably, the electromagnetic shield and the terminal pins are prepared from a single metal sheet by striking the metal sheet and bending the struck portions thereof, which also makes it easy to fabricate the detector unit.

The detector unit may further include an insect deterring cover which is molded from a plastic material to have a side wall and a bottom wall. The side wall is in the form of a screen which surrounds the labyrinth wall so as to prevent flying insects or the like foreign matters from entering the smoke chamber, and has a number of air vents permitting the entry of the smoke particles into the smoke chamber through the labyrinth wall. The bottom wall is provided for covering an open bottom of the base to close the smoke chamber. Formed on the interior surface of the bottom wall are first and second masks which make the light projector intact from a light not coming directly from the light emitting element and make the light collector intact from a scattered light not due to the presence of the smoke particles. Thus, the light reflected from the interior surface of the bottom wall can be successfully excluded from the smoke density detection to enhance the reliability of the smoke density detection.

Preferably, the side wall of the insect deterring cover is formed with at least one blind section devoid of the air vents. The blind section extends over a limited circumference of the labyrinth wall in an immediately opposed relation to one of the light projector and the light collector. The air vents on opposite of the blind section are so oriented as to direct the ambient air towards the labyrinth wall along a direction generally parallel to a line connecting the blind section to a geometric center of the base. Thus, the air on opposite of the blind section can be guided smoothly into the smoke chamber to compensate for deficiency of the air flow that is prevented from entering the smoke chamber by the presence of the blind section, which is necessary for avoiding any inadmissible light leak through around the light protector and the light collector.

The labyrinth wall includes a plurality of L-shaped studs each having an outside corner and an inside corner. The L-shaped studs are arranged circumferentially around the base in such a manner that the outside corner of the L-shaped stud projects into the inside corner of the adjacent L-shaped stud. Two of the L-shaped studs disposed forwardly of the light collector along an optical axis of the light collector are joined at the outside corners to form thereat a combined stud of a generally X-shaped configuration. The X-shaped combined stud is found advantageous to the entry of the ambient light into the field of view of the light collector, while minimizing the loss of the air flow into the smoke chamber.

The X-shaped combined stud is formed with a V-shaped recess which opposes to the light collector with respect to the optical axis thereof and constitutes a light trap responsible for preventing the incident light from reflecting towards the light collector.

The light trap in the form of the V-shaped recess is defined by a pair of first and second legs each being a part of the combined stud with the first leg located closer towards the light projector than the second leg. The light trap also includes a shield ledge which projects from the first leg and a concave at the bottom of the recess. The concave is hidden behind the shield ledge from the light projector. Thus, the light from the light projector as well as the light reflected from other portions of the smoke chamber can be successfully prevented from being reflected towards the light collector, thereby minimizing undesired stray light.

In order to further enhance the capability of minimizing the stray light, the light trap may be further provided with a reflecting section in the form of a serration which is opposed to the light collector and is configured to reflect the incident light deep into the V-shaped recess away from the light collector.

Further, the base is preferred to include a shielding post which projects at a location between the light trap and the light projector in a spaced relation respectively therefrom for interruption of the light from the light projector towards the light trap. The shielding post is also located outside of an incident angle of the light collector. Thus, the light collector is well protected from receiving the light not due to the presence of the smoke particles for increased detection reliability.

The light emitting element and the light receiving element are mounted on the circuit board so that, when the circuit board is secured to the base, the individual optical axes of these elements extend generally perpendicular to a plane of the base. In this connection, the light projector has a light projecting axis which extends within the smoke chamber in parallel with the plane of the base, and the light collector has a light collecting axis which extends within the smoke chamber in parallel with the plane of the base in a crossing relation with the light projecting axis. The light projector forms a first light guide which changes the direction of the light beam from the light emitting element to direct it along the light projecting axis. Likewise, the light collector forms a second light guide which changes the direction of the light collected along the collecting optical axis to direct it along the optical axis of the light receiving element. With this architecture, a light emitting diode (LED) utilized as the light emitting element can be mounted upright on the circuit board without being accompanied with an otherwise necessary awkward work of bending the leads of LED. Further, the upright mounting of LED can minimize the length of the leads and therefore an overall height dimension of the assembly of the base and the circuit board, contributing to give a low-profile structure of the detector unit.

Preferably, the light projector and the light collector are each in the form of an optical prism. The optical prism defining the light collector may includes an integrally formed converging lens which converges the collected light towards the light receiving element for improving detecting efficiency.

These and still other objects and advantageous features of the present invention will become more apparent from the following description of the preferred embodiments when taken in conjunction with the attached drawings.

DETAILED DESCRIPTION OF THE PREFERRED EMBODIMENT

Figure 1:
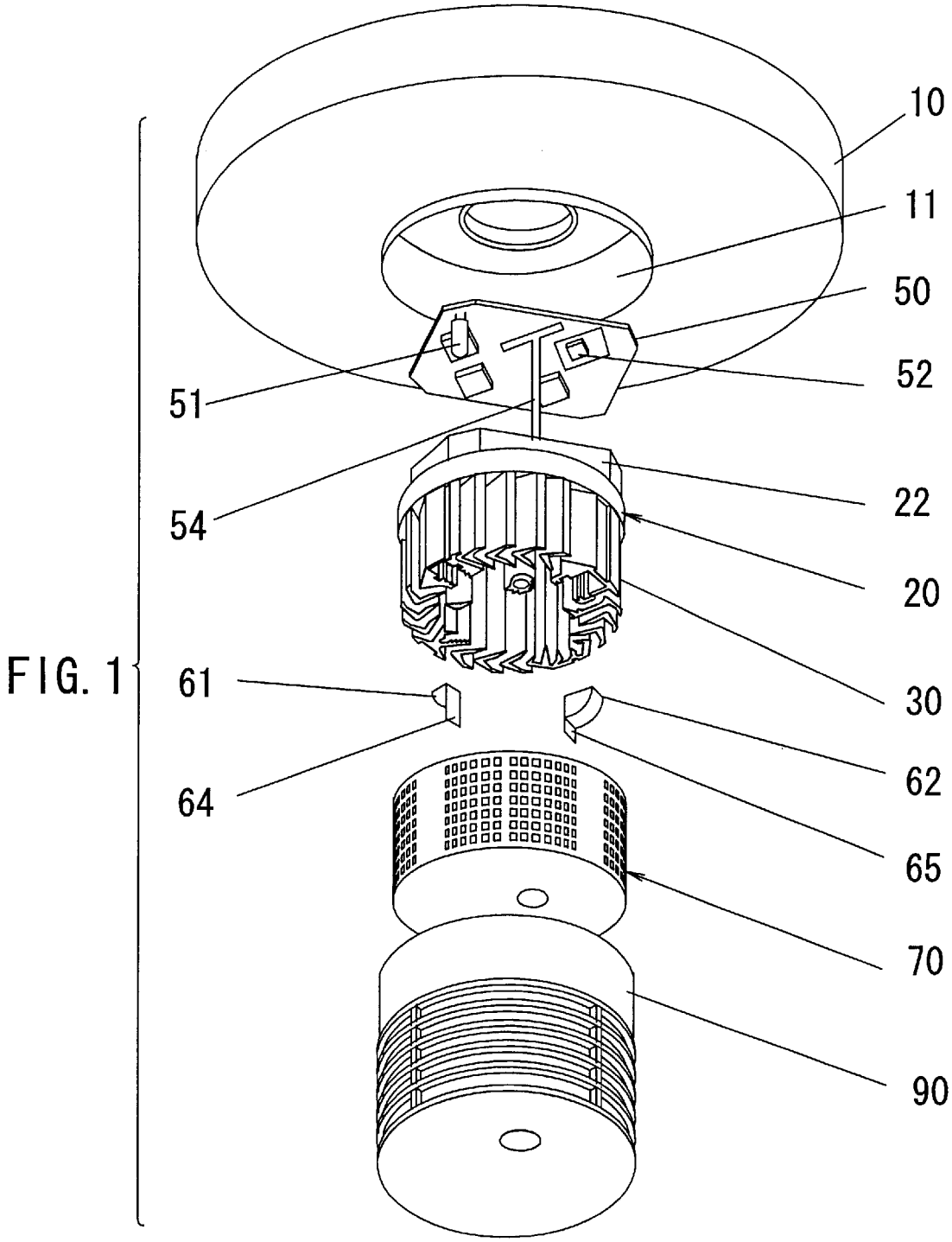
FIG. 1 is an exploded perspective view of a fire detector unit in accordance with a preferred embodiment of the present invention.
Figure 2:
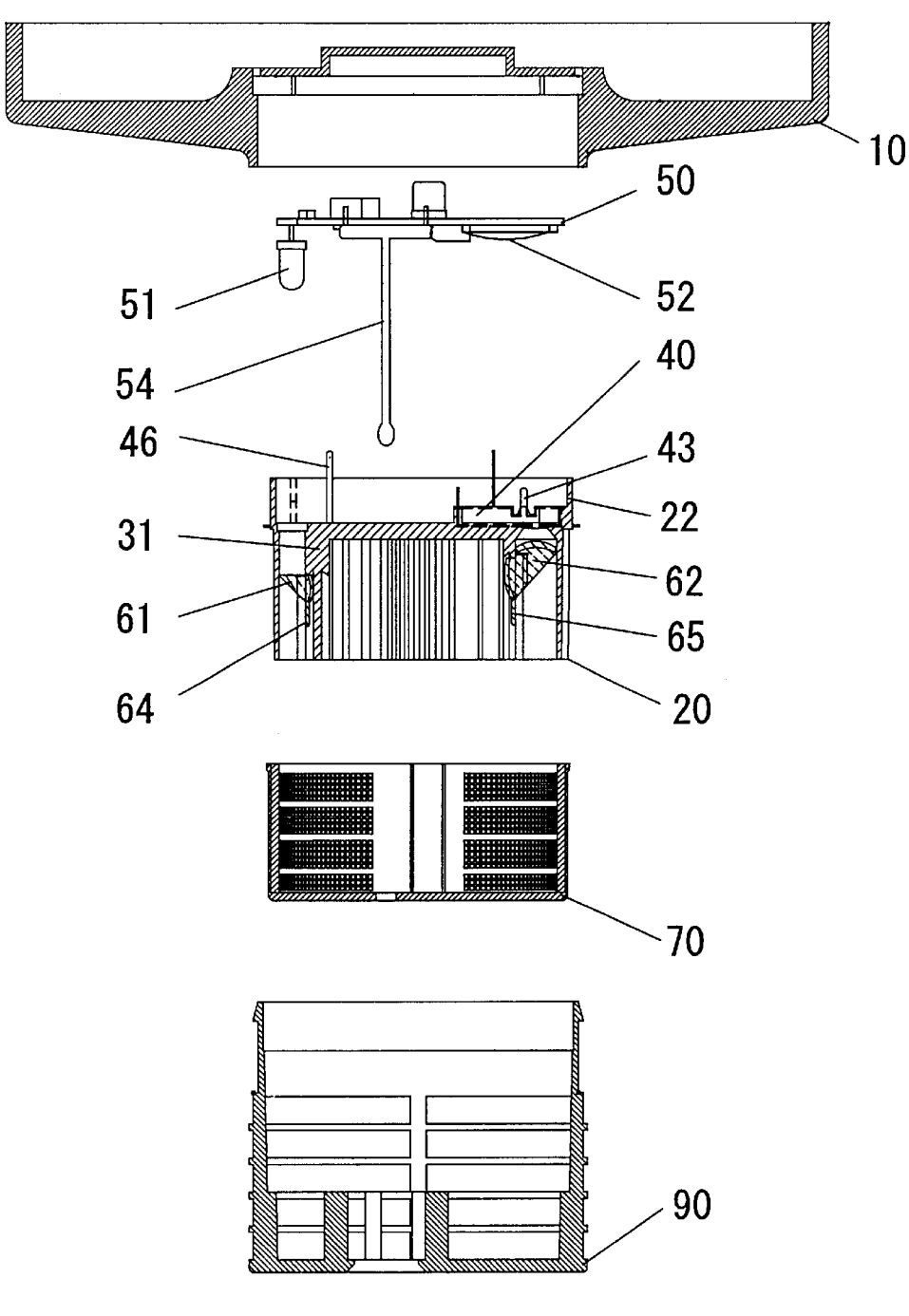
FIG. 2 is an exploded sectional view of the above fire detector unit.
Figure 3:
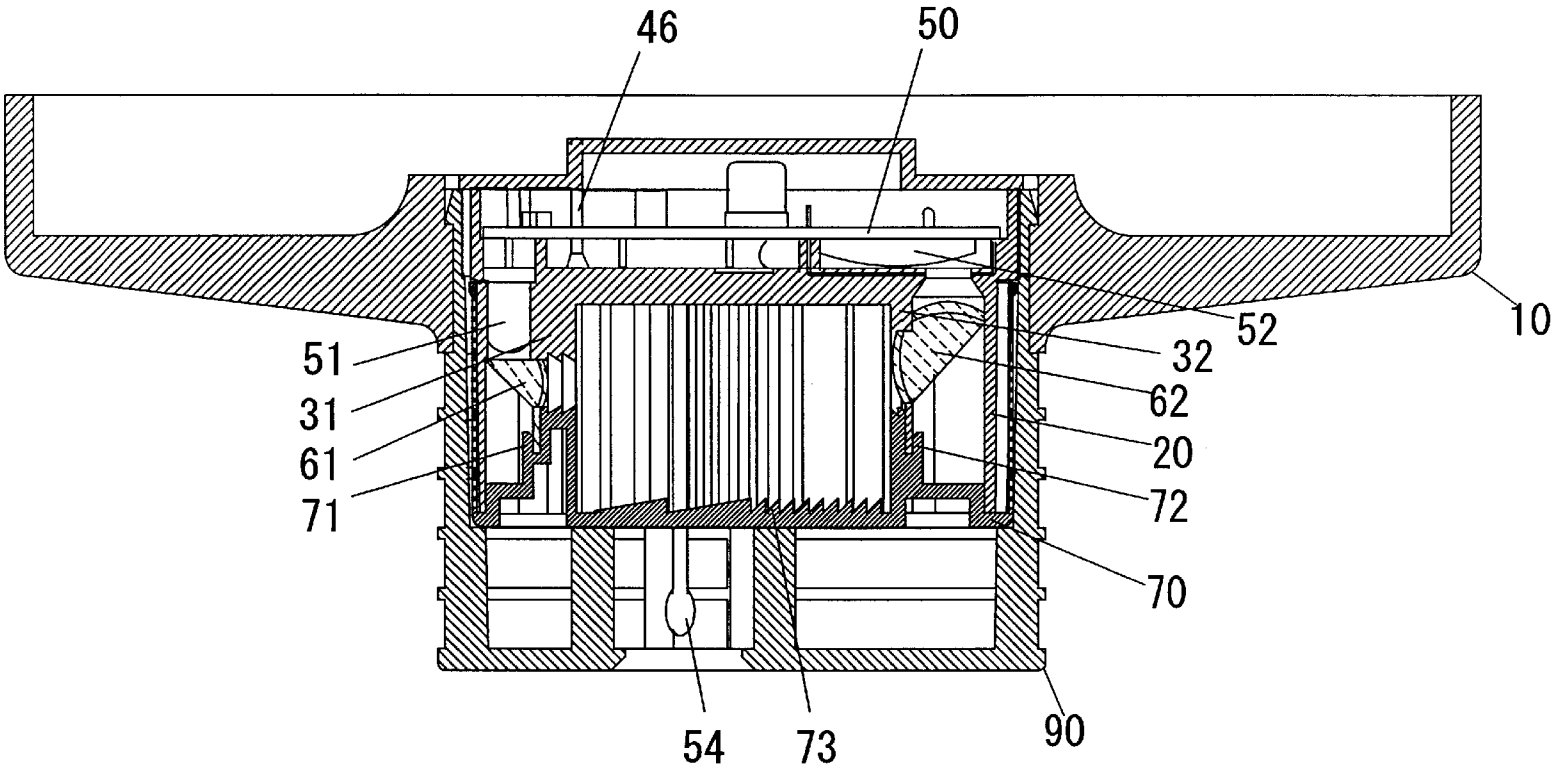
FIG. 3 is a sectional view of the above unit.

Referring now to FIGS. 1 to 3, there is shown a fire detector unit in accordance with a preferred embodiment of the present invention. The fire detector unit is a combination detector for detecting an environment temperature and a smoke density in the environment, and is utilized to determine a fire presence based upon the detected temperature and the smoke density. The smoke density is obtained as proportional to an amount of scattering light due to the presence of smoke particles. The fire detector unit includes a support 10 which is adapted to be installed on a ceiling or the like structure of a room. The support 10 holds an optical base 20 which accommodates various optical and electronic components, an insect deterring cover 70, and a guard 90. The base 20 is molded from a plastic material into a cylindrical shape having a closed top and an open bottom. The insect deterring cover 70 is also molded from a plastic material into a cylindrical shape with an open top and a closed bottom. The cover 70 is fitted over the base 20 to define therebetween a smoke chamber 24 for detection of the smoke density of the air introduced in the chamber. The guard 90 is also made of a molded plastic to fit over the cover 70 and is hooked at its top end to a periphery of a center recess 11 of the support 10, as shown in FIG. 3. Thus, the base 20 and the cover 70 are retained within the guard 90 and are secured to support 10.

As shown in FIG. 2, the base 20 has a top wall 21 with a brim 22 upstanding from the periphery of the top wall. Fitted into a rectangular space surrounded by the brim 22 is a circuit board 50 which mounts the electronic components which include a light emitting element (e.g. LED) 51, a light receiving element (e.g. a photo-diode) 52, a thermistor 54, and the other components forming a fire detecting circuit. The LED 51 and the photo diode 52 are mounted on the circuit board 50 with the individual optical axes extending perpendicular to the plane of the circuit board 50 and therefore to the plane of the top wall 21 of the base 20. The thermistor 54 projects outwardly through the smoke chamber 24 and the bottoms of the cover 70 for sensing the ambient temperature. As will be discussed in detail, the circuit board 50 is secured to the top wall 21.

Figure 5:
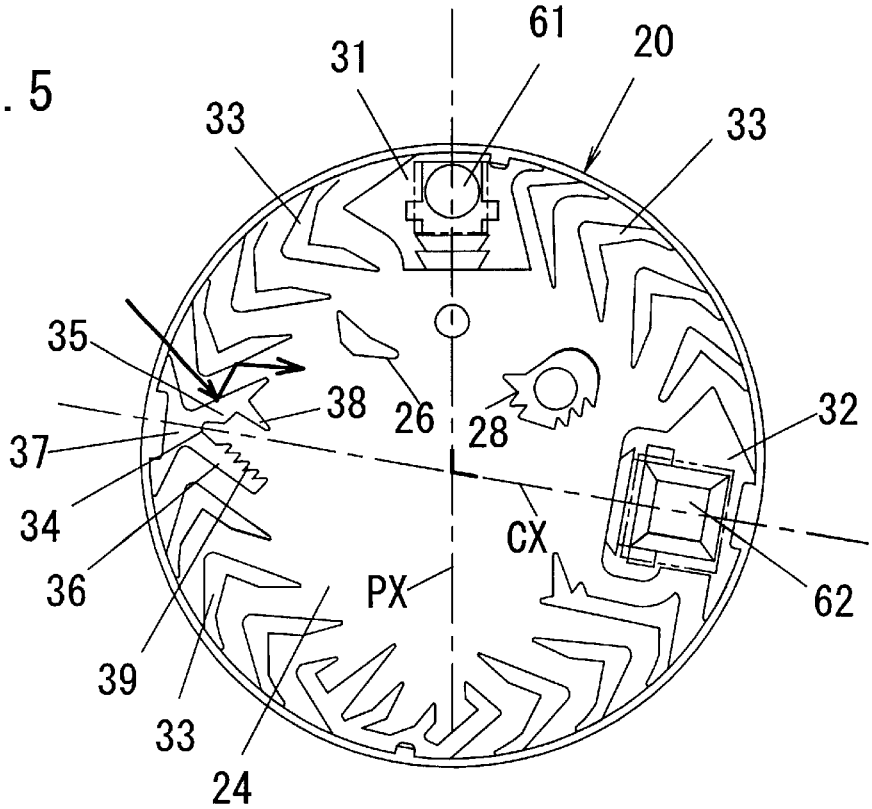
FIG. 5 is a bottom view of the base.
Figure 6:
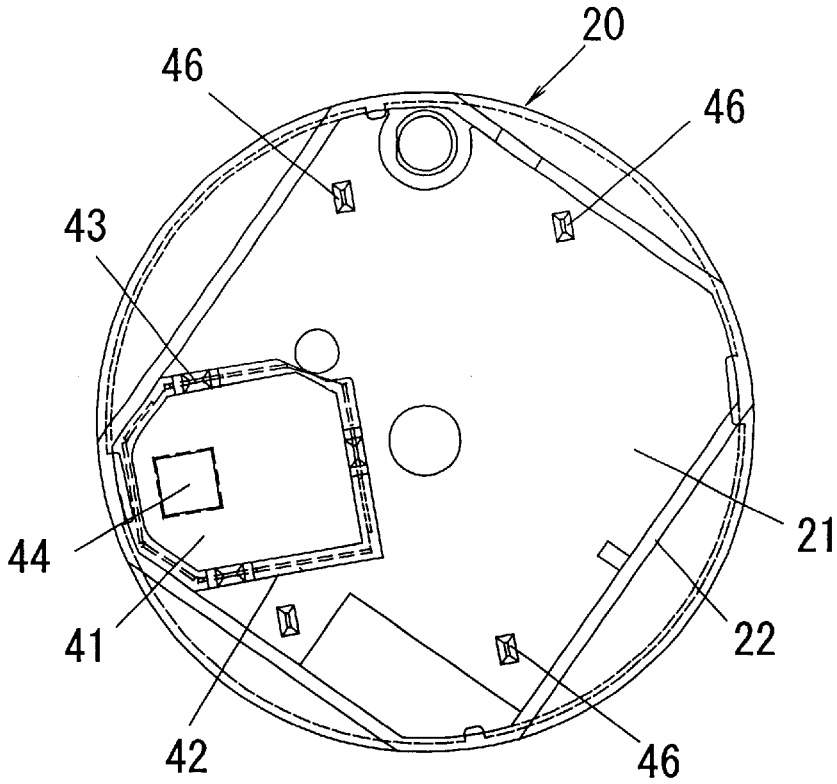
FIG. 6 is a top view of the base.

The base 20 also carries a light projector 61 in the form of a prism and a light collector 62 in the form of a combination prism and convex lens which are cooperative with the LED 51 and the photo-diode 52 to constitute an optical system for detection of the smoke density with regard to the air introduced into the smoke chamber 24. The base 20 has a labyrinth wall 30 which is a side wall surrounding the smoke chamber 24 and permits the entry of the ambient air but prohibits the entry of the ambient light into the smoke chamber 24. As shown in FIG. 5, the labyrinth wall 30 is defined by a plurality of L-shaped studs 33, and holders 31 and 32 for the light projector 61 and the light collector 62, respectively. The L-shaped studs 33 are arranged together with the holders along a circumference of the base 20 in such a manner that an outside corner of the stud 33 projects into an inside corner of the adjacent stud or a concave of the adjacent holder and a convex of the each holder projects into an inside corner of the adjacent stud 31, thereby forming a bent channel between the two adjacent ones of the studs and the holders for introducing the ambient air into the smoke chamber 24, as indicated by an arrowed line in FIG. 5.

Figure 14:
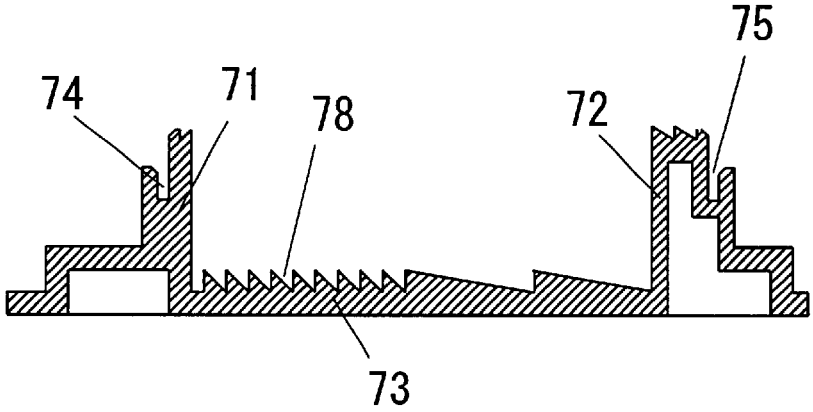
FIG. 14 is a section taken along line Y—Y of FIG. 12.
Figure 15:
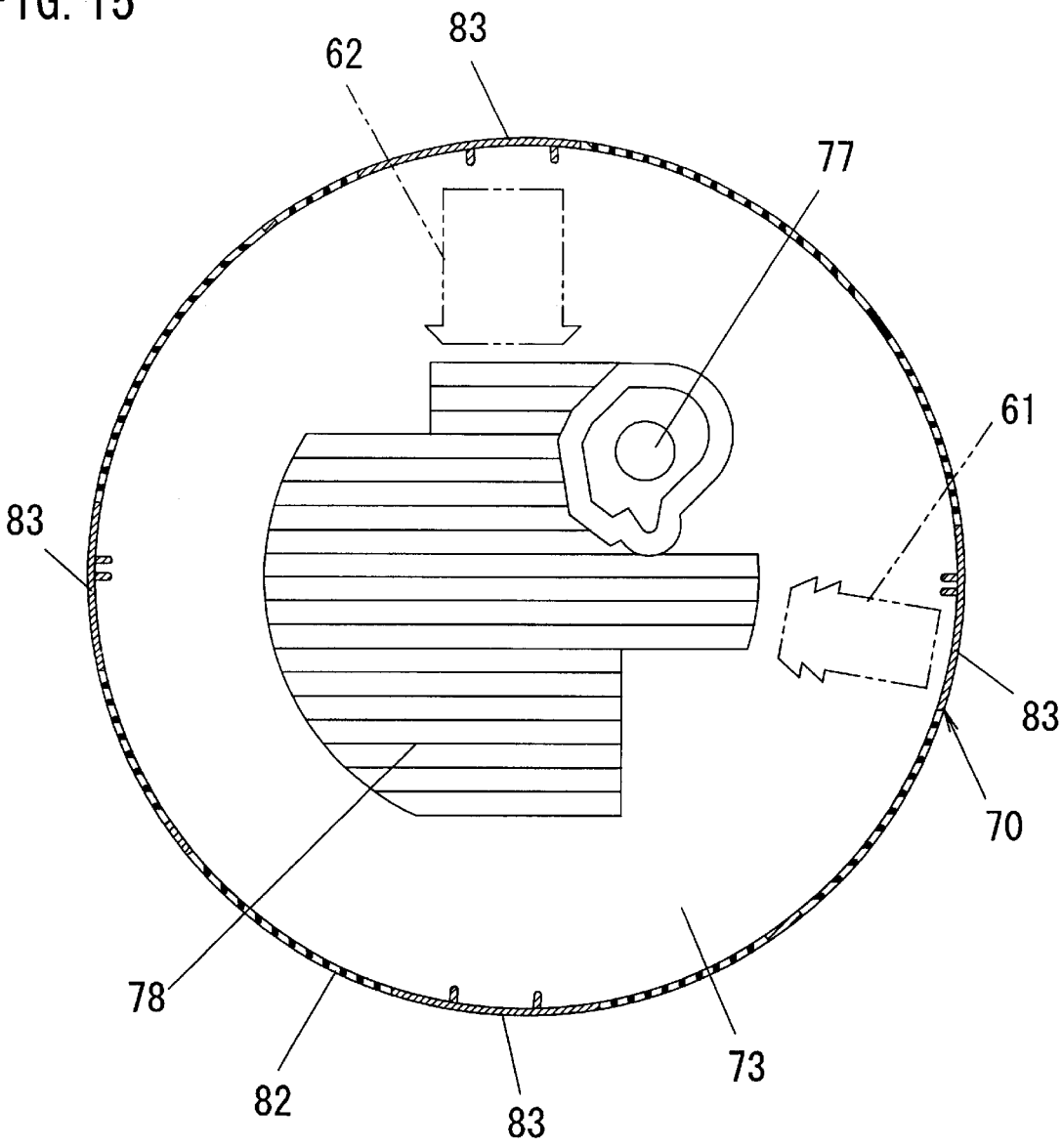
FIG. 15 is a section taken along line Z—Z of FIG. 13.

As shown in FIGS. 3 and 14, the cover 70 is formed on its bottom wall 73 with first and second retainers 71 and 72 respectively for retaining the light projector 61 and the light collector 62 in correct positions with tabs 64 and 65 of the light projector 61 and the light collector 62 being inserted into corresponding slits 74 and 75 of the retainers. The light projector 51 is set to orient its light projecting axis PX extending within the smoke chamber 24 in parallel with the top wall 21 of the base 20, while the light collector 62 is set to orient its light collecting axis CX extending within the smoke chamber in parallel with the top wall 21 of the base in a crossing relation with the light projecting axis PX at an angle of about 100 degrees, as shown in FIG. 15. The light projector 61 in the form of the prism has a function of changing the direction of the light beam from the LED 51 to direct it along the light projecting axis (PX). Likewise, the light collector 62 also in the form of the prism has a function of changing the direction of the light collected along the light collecting axis (CX) to direct it along the optical axis of the photo-diode 52. Thus, the scattering light due to the presence of the smoke particles can be collected by the photo-diode 62 so as to give the smoke density proportional to the amount of the smoke particles within the smoke chamber. With the inclusion of the converging lens in the light collector 62, the collected light can be successfully received at the photo-diode 52 to enhance the output thereof for reliable smoke density detection. This is particularly advantageous in that the photo-diode 52 can generally produce only a minute output on the order of pA for indication of a critical smoke density even under the condition that the LED 61 produces a light output on the order of mW.

The labyrinth wall 30 includes a light trap 34 at a portion diametrically opposed to the light collector 62, i.e., forwardly thereof along the light colleting axis (CX) in order to prevent a stray light from entering the light collector 62. The light trap 34 is in the form of an X-shaped combined stud in which the two adjacent L-shaped studs 33 join at their outside corners, and gives a V-shaped recess facing the light collector 62. The V-shaped recess is defined by first and second legs 35 and 36 each being a part of the combined stud and is formed at its bottom with a narrow concave 37 having a reduced angle of aperture. The first leg 35, which is closer to the light projector 61 than the second leg 36, is formed with a shield ledge 38 projecting in a direction of concealing the concave 37 therebehind from the light projector 61. While the second leg 36 is formed on its surface opposing the first leg with a serration 39 which reflects the incident light deep into the V-shaped recess away from the light collector 62. Thus configured light trap 34 can successfully avoid the incident light from reflecting towards the light collector 62, minimizing the influence of the stray light on the light collecting system and therefore enhancing the reliable smoke density detection.

Also as shown in FIG. 5, a shielding post 26 is formed halfway between the light projector 61 and the light trap 34 to keep the light trap intact from the direct beam from the light projector. The shielding post 26 is also located outside of an incident angle of the light collector 62 so as not to reflect the light towards the light collector. A tubular jacket 28 is formed halfway between the light projector 61 and the light collector 62 in order to pass through the thermistor 54.

Figure 4:
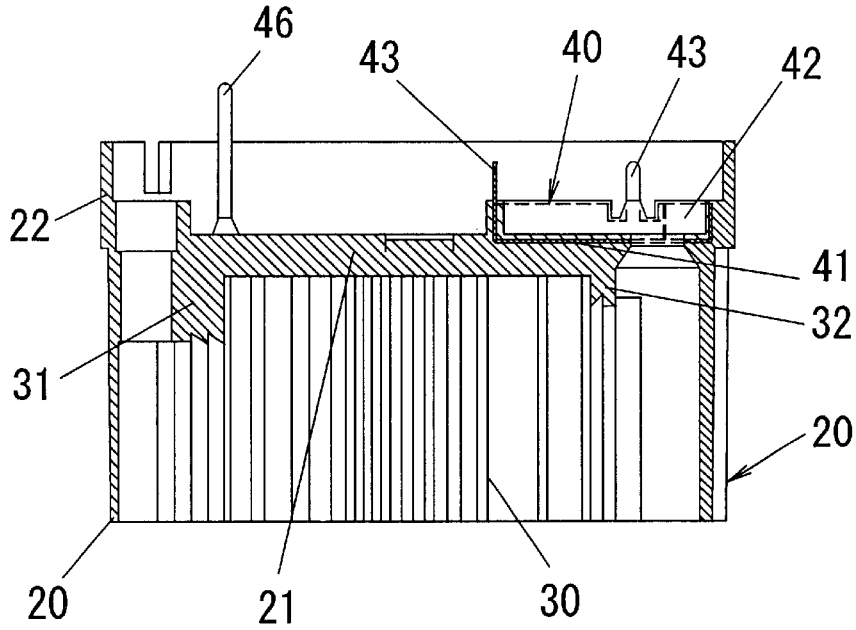
FIG. 4 is a vertical section of a base utilized in the above unit.
Figure 7:
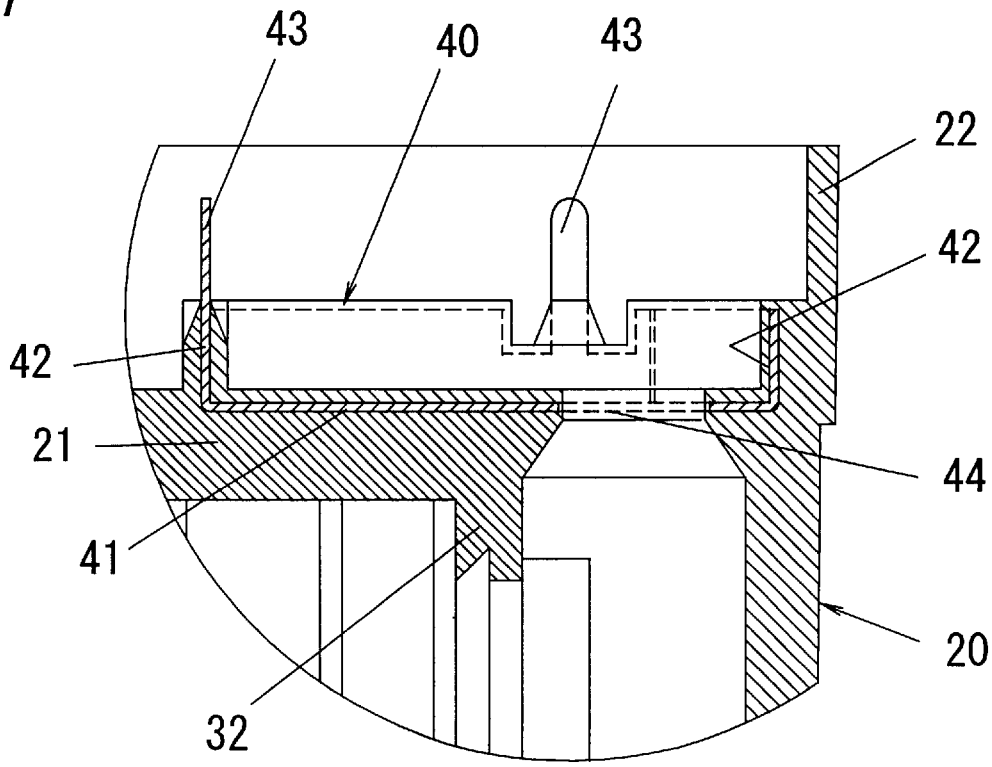
FIG. 7 is a vertical section showing an electromagnetic shield embedded in a portion of the base.

As shown in FIGS. 4 and 7, a metal-made electromagnetic shield 40 is integrated into the top wall 21 of the base 20 as a result of being embedded when molding the base 20, in order to give an electromagnetic protection over a portion of the circuit board 50, particularly the photo-diode 52 and the associated circuit which is susceptible to external electromagnetic waves or noises. The shield 40 is of a generally shallow configuration with an embedded flat bottom 41 and side rims 42 bent upward from the edges of the bottom 41 to surround the portion of the circuit board. Two of the side rims 42 is integrally formed respectively with ground terminals 43 which extend through the circuit board 50 for electrical connection with a ground line of the circuit board as well as for physical connection to the board by soldering. The bottom 41 of the shield 40 has a window 44 through which the photo-detector 52 communicates with the light collector 62. In addition, the base 20 carries molded-in terminal pins 46 which project from within the top wall 21 for soldering connection with the fire detection circuit on the board 50 positioned on the top wall 21, thereby physically securing the circuit board 50 to the base in cooperation with the ground terminals 43. The terminal pins 46 project through the circuit board 50 so as to be used for electrical connection with an external line in order to transmit the fire warning signal generated at the fire detection circuit to be indicative of the fire presence when the detected parameters become critical.

Figure 8:
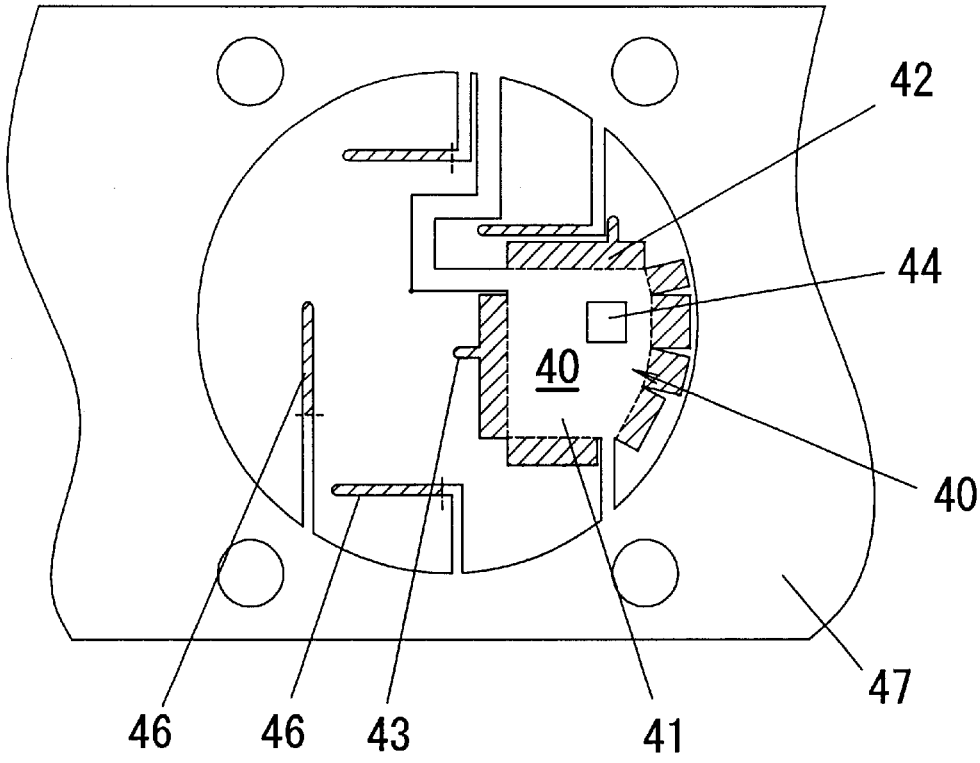
FIG. 8 is a plan view of a metal blank sheet from which the shield and terminal pins are struck out and molded into the base.
Figure 9A:
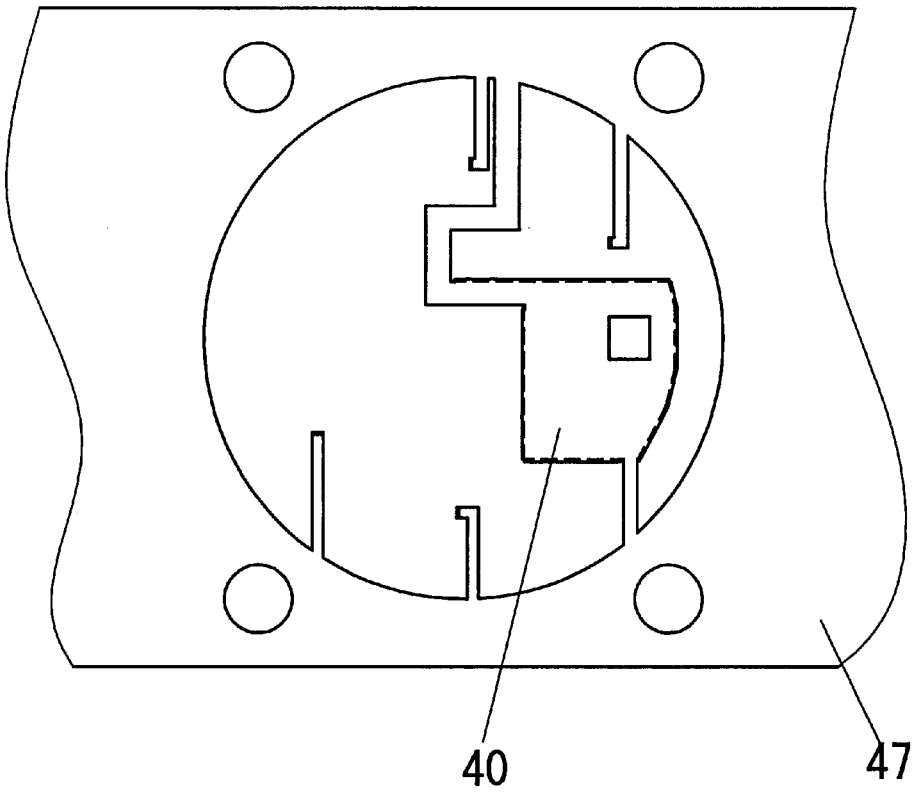
FIGS. 9A and 9B are a plan view and a side view respectively of the metal blank shown with the terminal pins and portions of the shield bent at a right angle with respect to the plane of the metal blank.
Figure 9B:
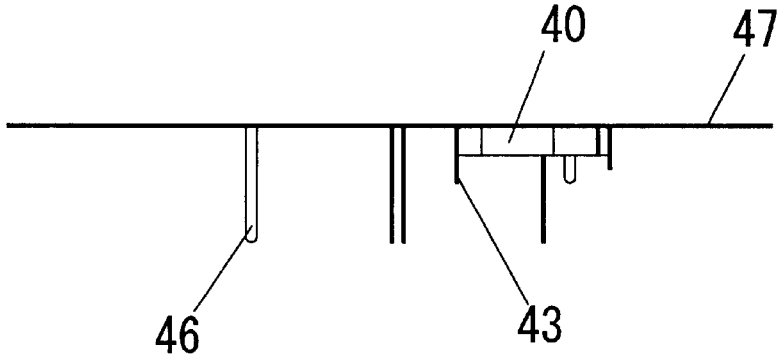
Figure 10A:
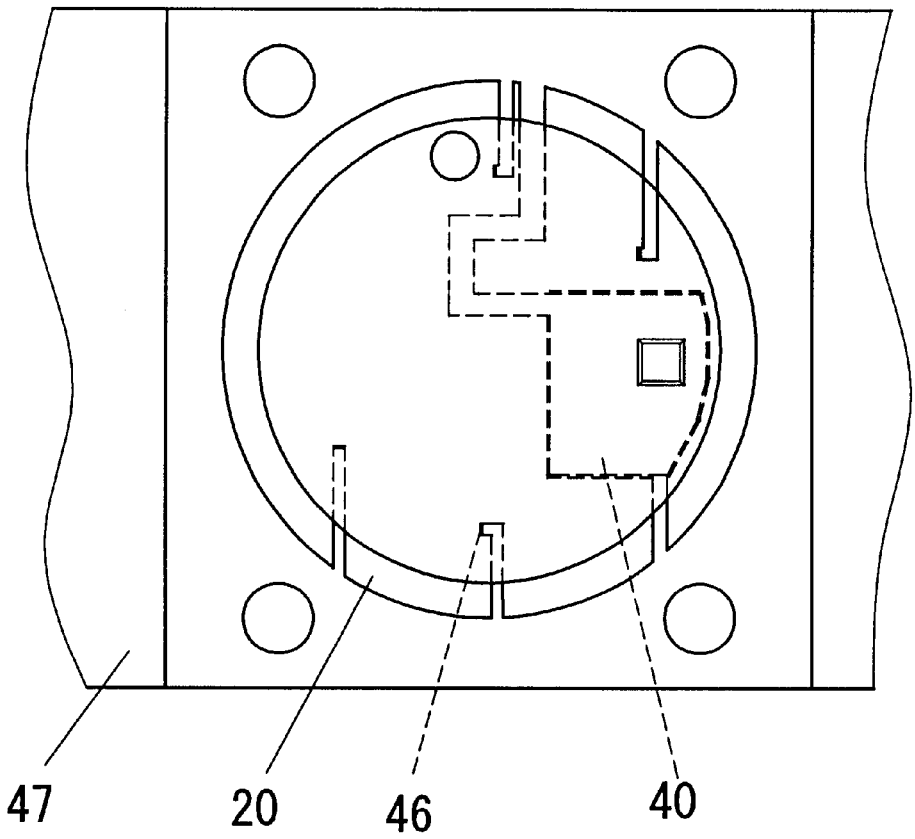
FIGS. 10A and 10B are a plane view and a side view respectively illustrating the portions of terminal pins and the shield molded into a fraction of the base.
Figure 10B:
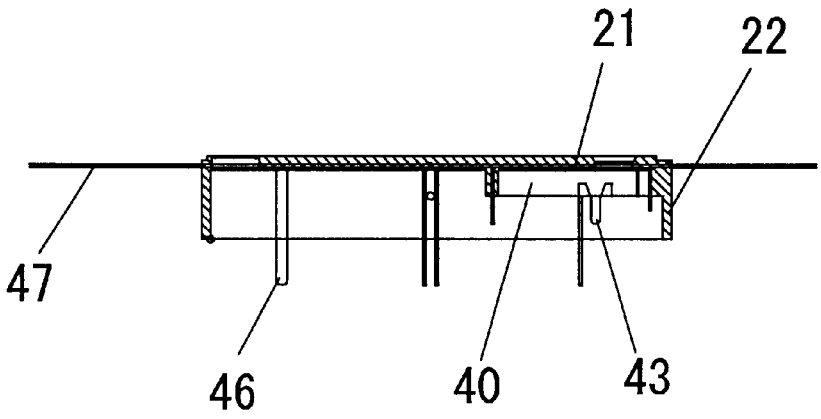
Figure 11A:
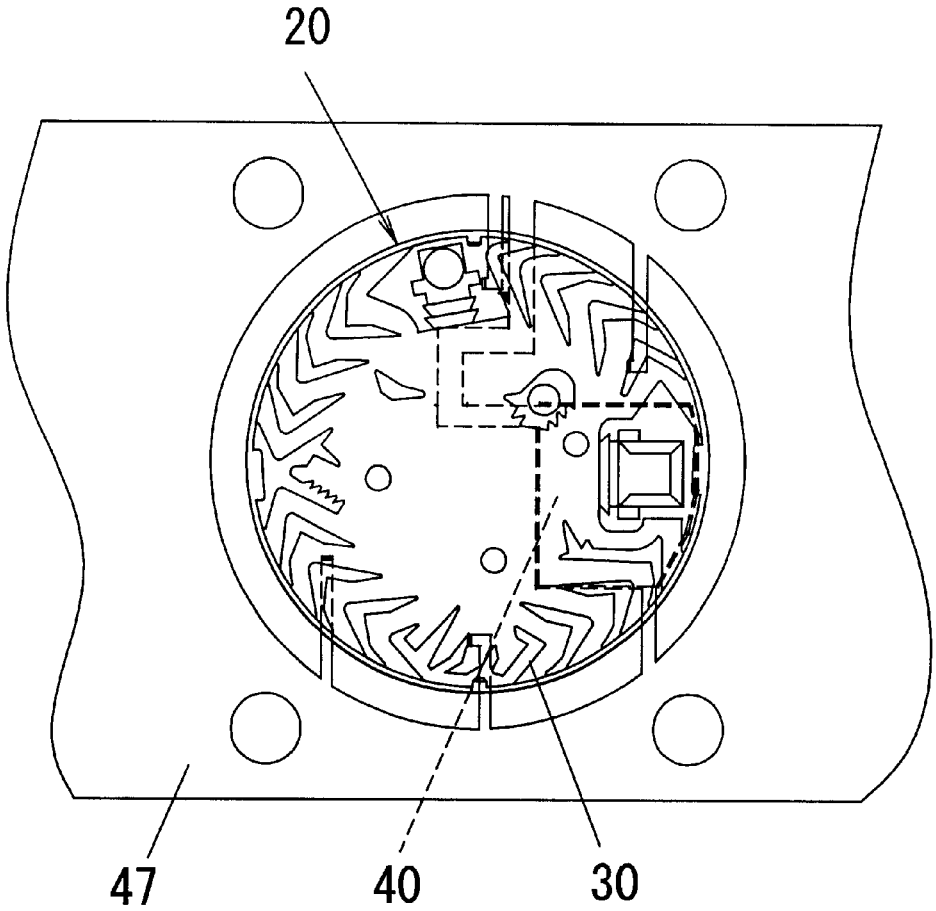
FIGS. 11A and 11B are a plan view and a side view respectively illustrating a complete base structure build up on the fraction of the base.
Figure 11B:
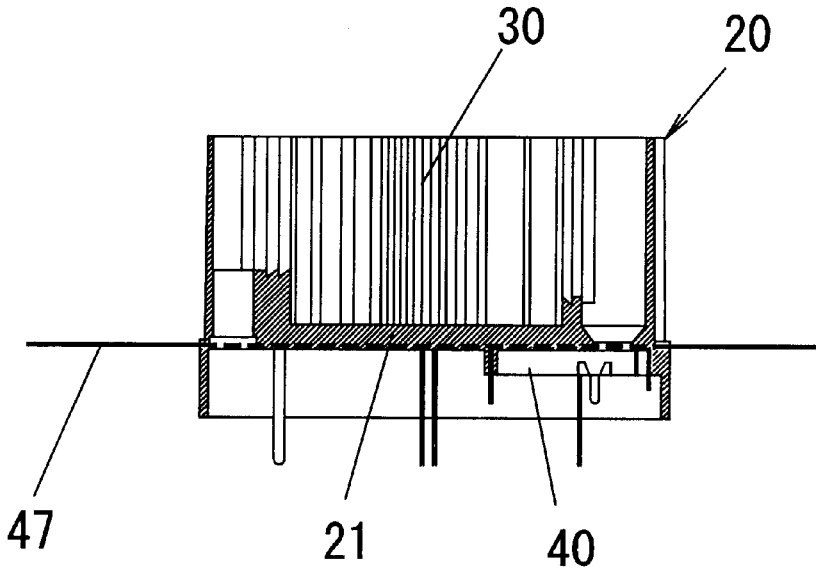

As shown in FIG. 8, the electromagnetic shield 40 and the terminal pins 46 are struck from a single metal sheet 47. Portions that are subsequently bent upward to form the side rims 42, ground terminals 43, and the terminal pins 46 are indicated by hatched lines in the figure. After these portions are bent as shown in FIGS. 9A and 9B, the metal sheet 47 is set in a molding die where the upper fraction of the base 20 is molded with the shield 40 and the terminal pins 46 being partially embedded in the upper fraction of the base 20, as shown in FIGS. 10A and 10B. Subsequently, the remaining fraction of the base 20 is molded integrally on the upper fraction thereof to complete the base 20 including the labyrinth wall 30, as shown in FIGS. 11A and 11B. Thereafter, the metal sheet 47 is cut out from thus molded base 20. In this sense, the base 20 is molded into a unitary structure including the labyrinth wall 20, the shield 40, and the terminal pins 46.

Figure 12:
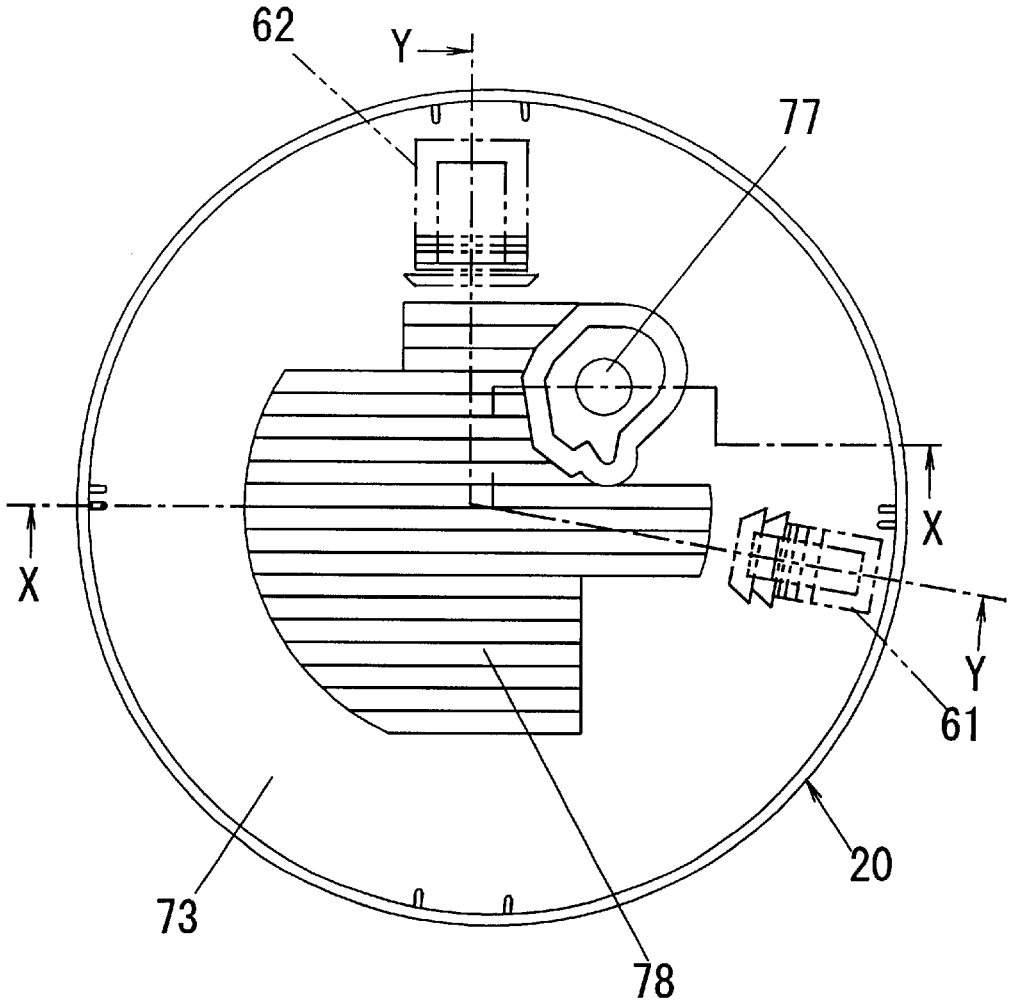
FIG. 12 is a top view of an insect deterring cover fitted over the base.
Figure 13:
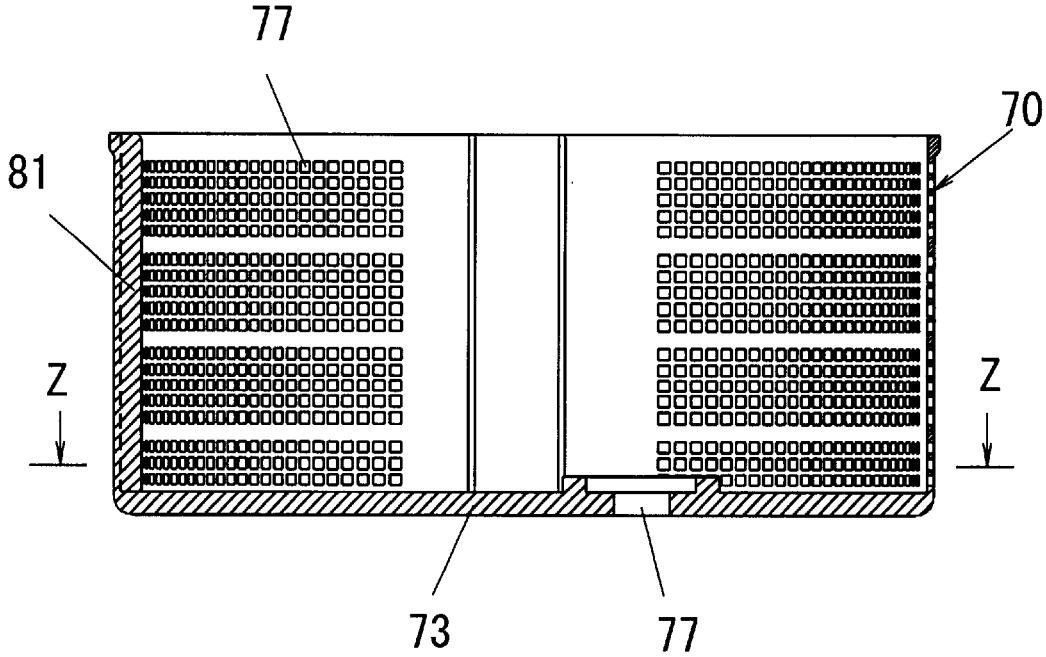
FIG. 13 is a section taken along line X—X of FIG. 12.

Turning to FIGS. 12 to 14, the insect deterring cover 70 is formed in its bottom wall 73 with an aperture 77 through which the thermistor 54 extends in such a manner as to prevent the entry of inadmissible lights into the smoke chamber 24. The retainers 71 and 72 projecting on the bottom wall 73 are configured to function as individual masks which prevent the inadmissible light from going towards the light projector 61 and the light collector 62, thereby protecting the light projector 61 intact from undesired light beams which would otherwise cause the light projector to direct a false light beam towards the light collector, and also protecting the light collector 62 intact from undesired light beams which would otherwise received at the light collector and cause an erroneous smoke density detection. Further, the bottom wall 73 is formed with a series of notches 78 which are so configured as not to reflect the stray light not due to the smoke particles towards the light collector 62.

Figure 16:
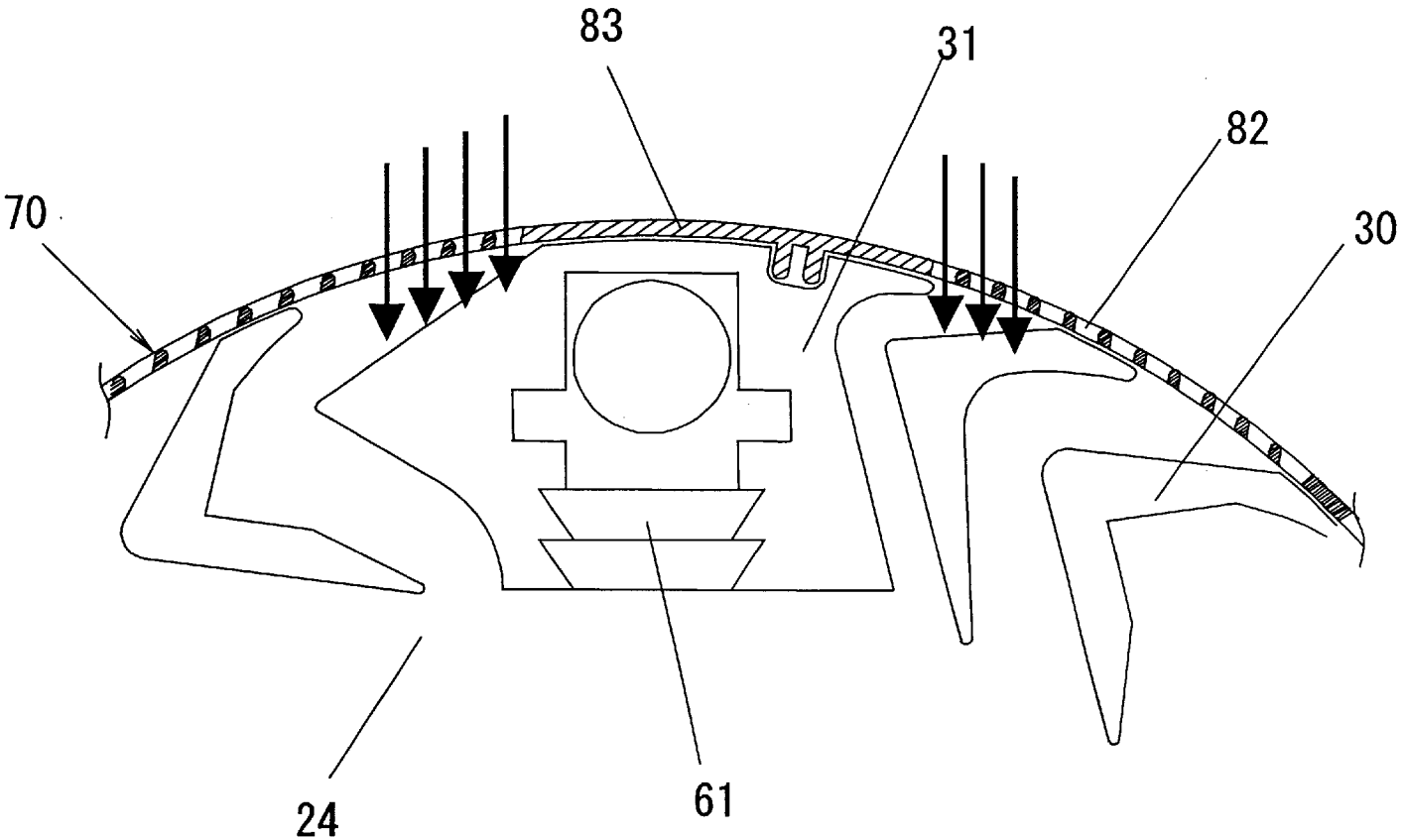
FIG. 16 is partial view cover illustrating an improved air guiding into a smoke chamber of the base.
Figure 17:
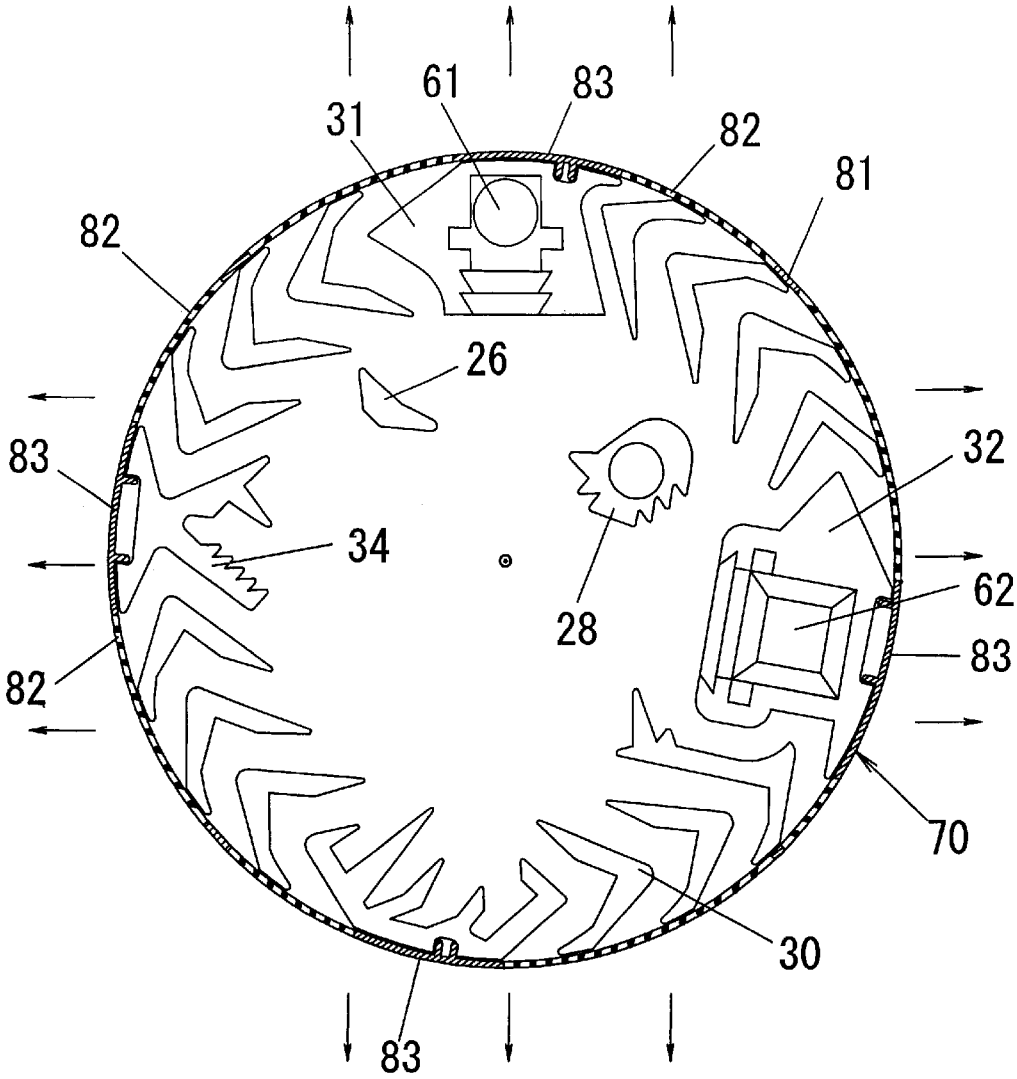
FIG. 17 is a bottom view, partly in section, of the base fitted with the insect deterring cover.

Formed in a side wall 81 of the cover 70 are a number of air vents 82 which permit the entry of the ambient air into the smoke chamber 24 through the labyrinth wall 30 of the base 20. As shown in FIGS. 15 and 17, the side wall 81 includes blind sections 83 which are circumferentially spaced to conceal therebehind the light projector 61, the light collector 62, and the portions of the labyrinth wall diametrically opposite to the light projector and the light collector in order to eliminate the entry of the inadmissible light into the smoke chamber. The air vents 82 on opposite of each blind section 83 are so oriented as to direct the ambient air towards the labyrinth wall 30 along a direction generally parallel to a line connecting the blind section to a geometric center of the base, as indicated by arrowed lines in FIG. 16. Thus, the air flowing in that direction towards around the blind sections 83 can be smoothly guided into the smoke chamber 24 to thereby compensate for insufficiency of the air flow due to the provision of the blind sections 83. The orientation of the air vents 82 is determined by separate outer molding dies which are used to fabricate the cover 70. That is, four outer molding dies are used in combination of a core die to surround the entire circumference of the cover 70. Each of the four outer molding dies, which are separated in mutually perpendicular directions as indicated by arrowed lines in FIG. 17, is configured to leave the blind section 83 in the middle of the circumferential length of the die and to leave the air vents 82 uniformly oriented in the separating direction such that the air vents 82 on opposite of the blind section 83 are oriented in the direction generally parallel to the line connecting the blind section 83 and the geometrical center of the cover 70.

Figure 18:
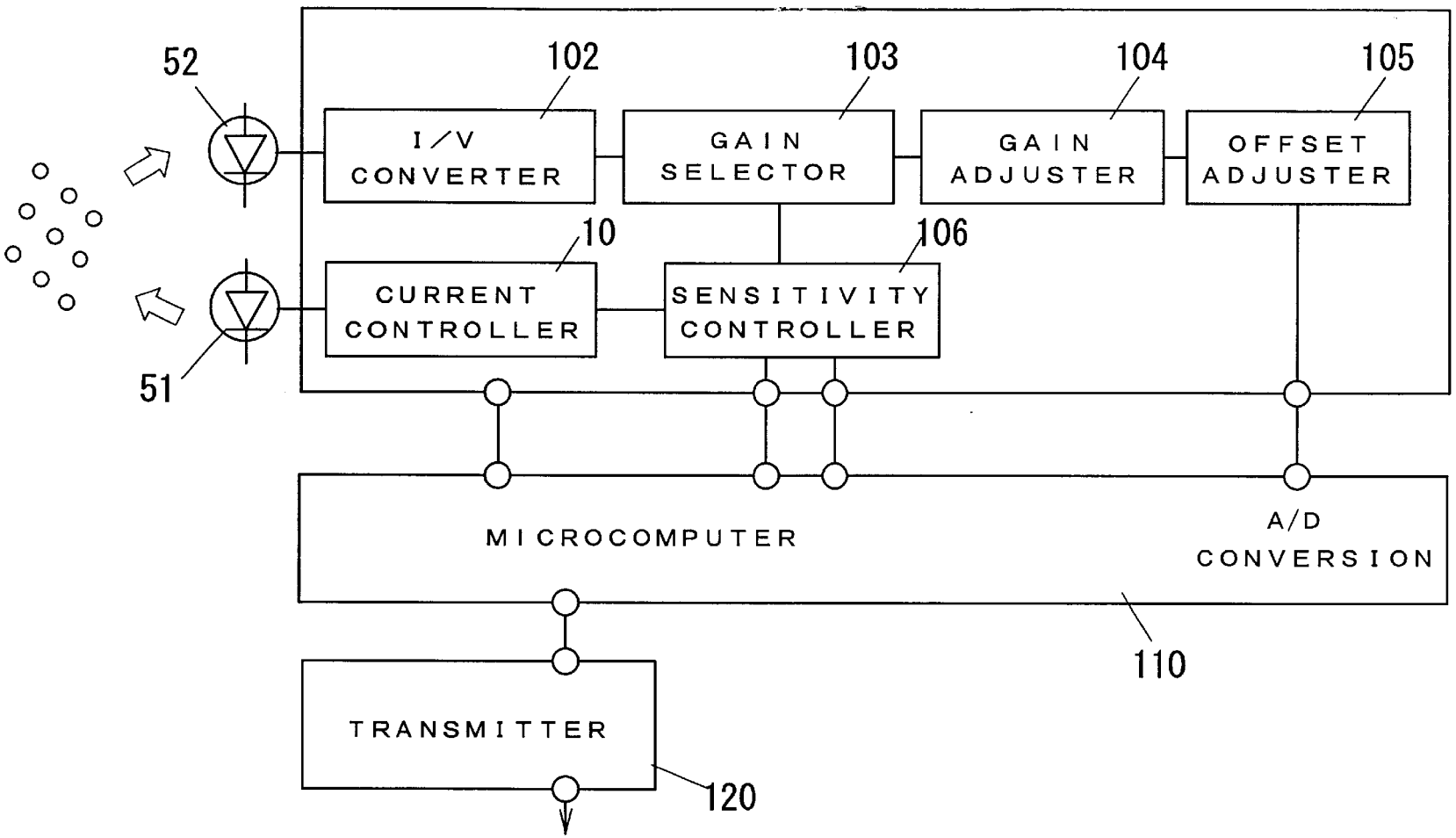
FIG. 18 is a block diagram of an electronic circuit incorporated in the above detector unit.

As shown in FIG. 18, the fire detecting circuit realized by the circuit board 50 includes a light generating and receiving section 100, a microcomputer 110 responsible for determining the fire presence to generate the fire warning signal, and a transmitter 120 which transmits the fire warning signal through the external line to a fire supervising station. The section 100 includes a current controller 101 for controlling a current being fed to the LED 51 for a controlled light output therefrom, a current-voltage (I/V) converter 102 for converting the current output of the photo-diode 52 into a corresponding output voltage. The output voltage is amplified at a gain selector 103 at a suitable amplification factor and is regulated to a suitable voltage level at a gain adjuster 104 followed by being processed at an offset adjuster 105 to provide an analogue signal indicative of the detected smoke density. A sensitivity controller 106 is provided for adjustment of the gain amplification factor at the gain selector 103 as well as for adjustment of the current being supplied to the LED 51. The analog output is converted into a digital value in the microcomputer 110 which issues the fire warning signal when the detected smoke density alone or in combination with the detected temperature satisfies a predetermined criteria.

What is claimed is:

1. A fire detector unit, comprising:

a base made of a molded plastic to have a labyrinth wall which projects on the circumference of said base to define therein a smoke chamber, said labyrinth wall permitting an entry of smoke particles but prohibiting the entry of an ambient light into said smoke chamber;

a light projector carried on said base and directing an incident light from a light emitting element into said smoke chamber;

a light collector carried on said base and collecting a light scattered by the smoke particles in said smoke chamber to a light receiving element, said light receiving element generating an electric signal indicative of the amount of the light received;

a fire detecting circuit being connected to receive said electric signal so as to provide a fire warning signal based upon said electric signal; and a circuit board mounting said light emitting element, said light receiving element, and electronic components forming said fire detecting circuit;

a metal-made electromagnetic shield which protects said light receiving element from electromagnetic radiation noises;

wherein said electromagnetic shield is integrally molded into said base and has a ground terminal for connection with a ground line of said circuit board, said circuit board being fixed to said base by means of metal-made terminal pins which are integrally molded into said base and are electrically connected to said fire detecting circuit, said terminal pins projecting through the circuit board for connection with an external line so as to transmit said fire warning signal;

wherein said labyrinth wall comprises a plurality of L-shaped studs each having an outside corner and an inside corner, said L-shaped studs being arranged circumferentially around said base in such a manner that the outside corner of the L-shaped stud projects into the inside corner of the adjacent L-shaped stud, two said L-shaped studs disposed forwardly of the light collector along an optical axis of the light collector being joined at the outside corners to form a combined stud of a generally X-shaped configuration.

2. The fire detector as set forth in claim 1, wherein said combined stud gives a light trap in the form of a V-shaped recess which opposes to said light collector with respect to the optical axis thereof, said light trap preventing the incident light from reflecting towards the light collector.

3. The fire detector as set forth in claim 2, wherein the V-shaped recess of said light trap is defined by a pair of first and second legs each being a part of said combined stud with the first leg located closer towards said light projector than the second leg, said light trap including a shield ledge projecting from said first leg and a concave at the bottom of the recess, said concave being hidden behind said shield ledge from said light projector.

4. The fire detector as set forth in claim 2, wherein said light trap includes a reflecting section in the form of a serration which is opposed to said light collector and is configured to reflect the incident light deep into said V-shaped recess away from said light collector.

5. The fire detector asset forth in claim 2, wherein said base includes a shielding post projecting at a location between said light trap and said light projector in a spaced relation respectively therefrom for interruption of the light from said light projector towards said light trap.

6. The fire detector as set forth in claim 5, wherein said shielding post is located outside of an incident angle of said light collector.

* * * * *